US005794809A

United States Patent [19]

Shuval

[11] Patent Number: 5,794,809

[45] Date of Patent: Aug. 18, 1998

[54] TRASH CONTAINER WITH AUTOMATIC LINER BAG FEED

[76] Inventor: Shlomo Shuval, 2124 Acton St., Berkeley, Calif. 94702

[21] Appl. No.: 802,028

[22] Filed: Feb. 18, 1997

[51] Int. Cl.[6] ..... B65D 85/59

[52] U.S. Cl. ..... 220/407; 220/908

[58] Field of Search ..... 220/407, 404, 220/403, 908

[56] References Cited

U.S. PATENT DOCUMENTS 5,031,793 7/1991 Chen et al. ..... 220/407

5,294,017 3/1994 Li ..... 220/407

5,628,424 5/1997 Gola ..... 220/407

5,632,401 5/1997 Hurd ..... 220/407

*Primary Examiner*—Joseph M. Moy

*Attorney, Agent, or Firm*—Linval B. Castle

[57] ABSTRACT

A small trash container using plastic liner bags which are interconnected perforations and are supplied in a roll which is stored on an exterior wall of the container. The bags are fed into the container through a slot in the lower wall and are manually pulled up to receive the trash. The filled bag is then torn from the roll and a new bag installed.

7 Claims, 4 Drawing Sheets

TRASH CONTAINER WITH AUTOMATIC LINER BAG FEED

This invention relates generally to household trash containers and particularly to a novel trash container in which an empty plastic liner bag automatically appears from the bottom of the container as a full bag is removed from the top.

BRIEF SUMMARY OF THE INVENTION

Nearly every kitchen has a trash container for temporarily disposing of damp kitchen waste and table scraps until they are carried to the larger garbage can. These trash containers are often an open waste basket or a hinged cover trash container that is usually kept lined with a paper or plastic bag in order to absorb or retain fluids and juices from the trash. The full trash bags are removed from the container and usually closed with a wire or plastic closure, and a new clean trash bag is then inserted into the container. This sounds like a simple task, but locating a clean trash bag can often be a time consuming and frustrating task, particularly In a small kitchen area. Grocery bags recovered from the grocery stores make very good trash bags but are inconvenient because they are separate items that are difficult to store in a kitchen. The only real satisfactory bag for ease of storage are rolls of interconnected bags that may be torn off as needed. The difficulty with rolls of bags is that the rolls get into a cabinet along with other plastic and wax paper rolls and become difficult to find when needed..

This invention is for a trash container that stores, on the exterior of the container, a supply of interconnected trash bags in conventional rolls and introduces them through the lower end of the container to the top where the top bag may be filled and then torn from the roll to thereby automatically introduce the next bag which is pulled up and opened in a conventional manner.

DESCRIPITON OF THE DRAWINGS

In the drawings that illustrate the preferred embodiment of the invention:

DETAILED DESCRIPTION OF THE PREFERRED EMBODIMENT

The trash container to be described is intended to be a convenience in a household and particularly in the kitchen where the trash consists of damp objects. It is convenient because the container carries its own supply of plastic liner bags which are stored on an exterior side of the container and are fed from a roll of interconnected bags from a bottom wall and up to the wide mouth of the container where they may be filled, closed and then torn from the roll.

Figures 1, 2:
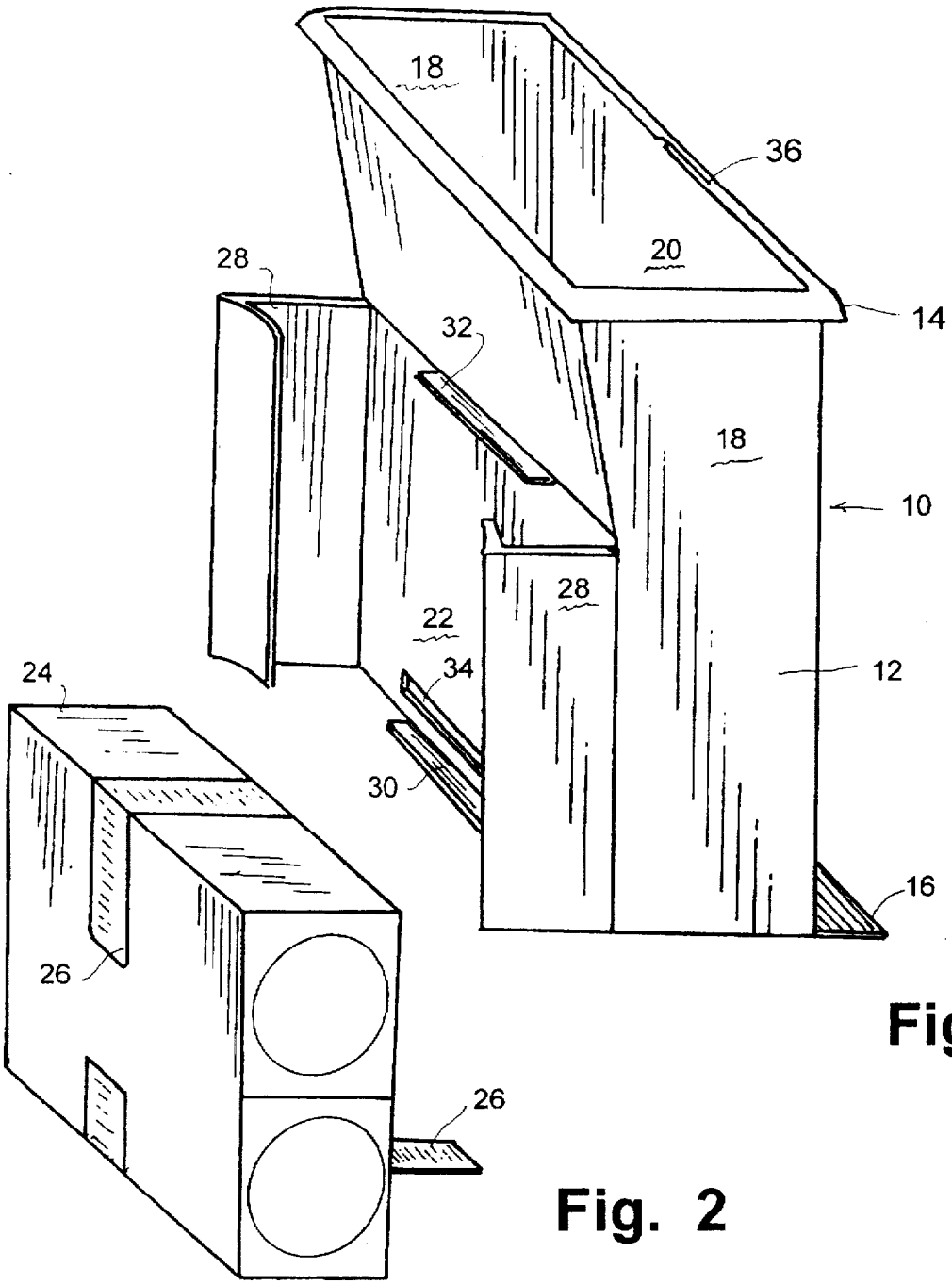
FIG. 1 is a perspective view of the trash container of the invention.
FIG. 2 is a perspective view of a box containing two rolls of trash bags ready for installation in the trash container.

FIG. 1 is a view showing the trash container 10 and FIG. 2 illustrates a typical double roll box of plastic liner bags that fit into the container. The container 1O has a main body 12 that is merely a rectangular box having four side walls and a bottom. The top of the container is open and has a surrounding narrow horizontal rim 14. The rectangular container body 12 is shown with opposing narrow side walls 18 separated by opposing side walls 20 and 22. Extending from one side wall 20 and level with the container floor is a hold down plate 16 that is used to hold the container in place while lifting out a loaded plastic bag.

FIG. 2 shows the plastic bags with two rolls per rectangular box 24, each roll attached to its respective opening tear strip tab 26 which opens that particular part of the box 24. Thus when a tear strip tab 26 is torn from the box, the box is opened and pulling on the tear strip tab will pull out the leading plastic bag from that particular roll of interconnected bags.

Returning to the description of FIG. 1, the box 24 of plastic bags is held in position with its opening against the side wall 22 by resilient vertical clamps 28 and horizontal extensions 30 and 32 which extend out at a right angle from the surface of the wall 22 with the extension 30 being flush with the floor of the container box 12. To insert or remove a plastic bag box 24 from the container 1O, it is only necessary to spring either one of the vertical clamps 28 and set the box between the extensions 30,32.

Figure 3:
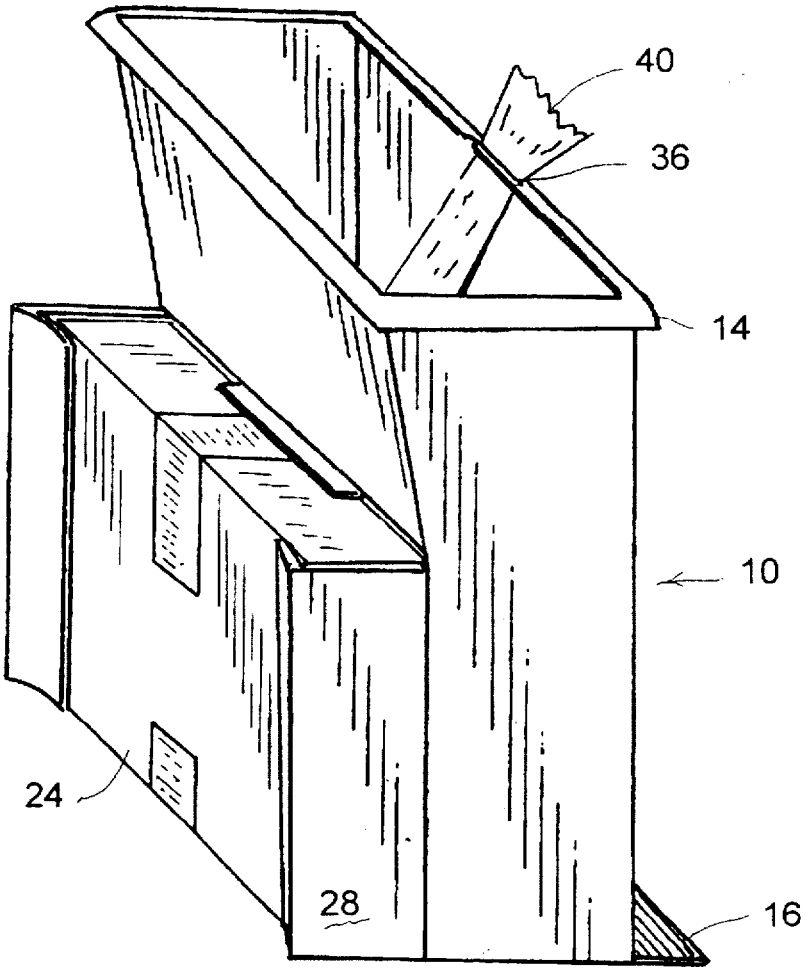
FIG. 3 is a perspective view of the trash container with installed box of bags.

Located approximately half an inch above the level of the floor of the container box 12 and in the side wall 22 is an elongated open slot 34 approximately half an inch in height and having sufficient length parallel with the container box floor to enable a plastic bag to pass through from the bag supply box 24 into the container box 12. Thus, when the plastic bag box 24 is loaded upon the trash container 10, as shown in FIG. 3, the tear strip tab 26 on the box 24 is straightened as shown in FIG. 2 and inserted into the slot 34 in the side wall 22. Then it is a simple task to reach down through the open top of the container and pull up the tab 26 and the attached plastic bag where it may be opened over the top of the container box 12 and, if necessary, secure under the rim 14.

The interconnected plastic bags in a roll are separated by a line of perforations that permit easy separation of the bags. Therefore, when a bag spread out over the rectangular opening of the trash container 10 has been filled, it's top is closed with a conventional closure and the bag is lifted so that it may be torn at the perforations from the following empty bag. If the trash container 10 is not otherwise secured the lifting of a full bag may also lift the container, therefore it may be advantageous to place one foot on the hold down plate 16 to secure the container.

Figure 4:
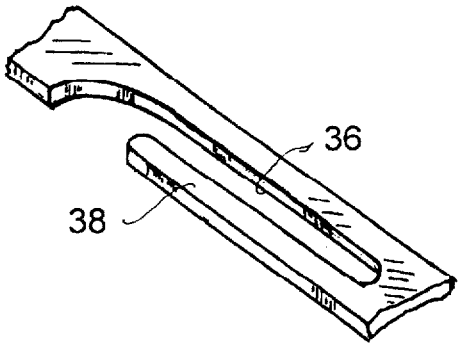
FIG. 4 is a perspective view of the detail of the bag tear-off slot.

FIG. 4 illustrates a bag tear-off slot 36 formed in the horizontal rim 14 of the side wall 20. The tear-off slot is formed by bending a thin strip 38 of metal or plastic from the rim into the container opening, leaving a small gap or slot 36 which may be used to grasp the plastic of an empty bag. When a filled trash bag has been removed from the container, it is only necessary to slide the following empty bag 40 into the gap 36 to hold the empty bag while the full bag is torn off at the perforations.

Figure 5:
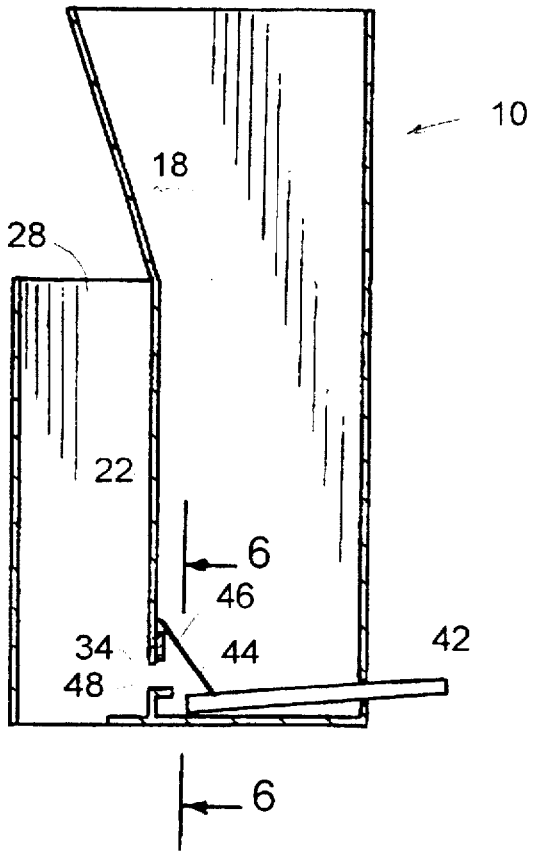
FIG. 5 is a sectional view illustrating an alternative foot operated bag tear-off device.

FIG. 5 is a sectional elevational view of an embodiment of the trash container illustrating an alternate method for holding the bag supply while a full bag is torn from the roll. In FIG. 5, the stationary hold down plate 16 of FIG. 3 has been replaced with a hold down lever 42 which, when stepped upon, lifts the rods 44 pivotally attached to the interior end of the lever 42. Stepping upon the lever 42 will lift the rods 44 to cause a gate 46 to lower against a narrow shelf 48 at the bottom of the slot 34 in the side wall 22 to prevent further unrolling from the bag supply.

Figure 6:
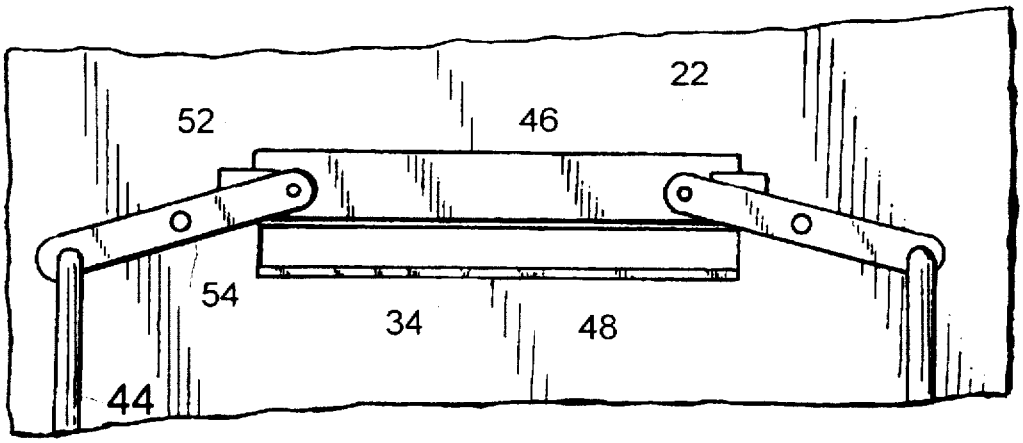
FIG. 6 is a detail view taken along the lines 6—6 of FIG. 5.

FIG. 6 is a enlarged detail view taken along the lines 6–6 of FIG. 5 and illustrates the gate 46, the rods 44 and pivoting members 50 that force the gate downward as the rods 44 are raised. The pivoting member 50 have holes in one end for receiving the rods 44 and are pivotally coupled to the gate 46 at the opposite end. The members are also pivotally connected to the side wall 22 by suitable standoffs 54 that provide clearance for the members to ride over stationary gate guides 52 secured to the side wall 22. If desired the edge of the gate 46 that contacts the shelf 48 may have a non-slip surface, such as a rubber lining or piercing points on the edge.

Figure 7:
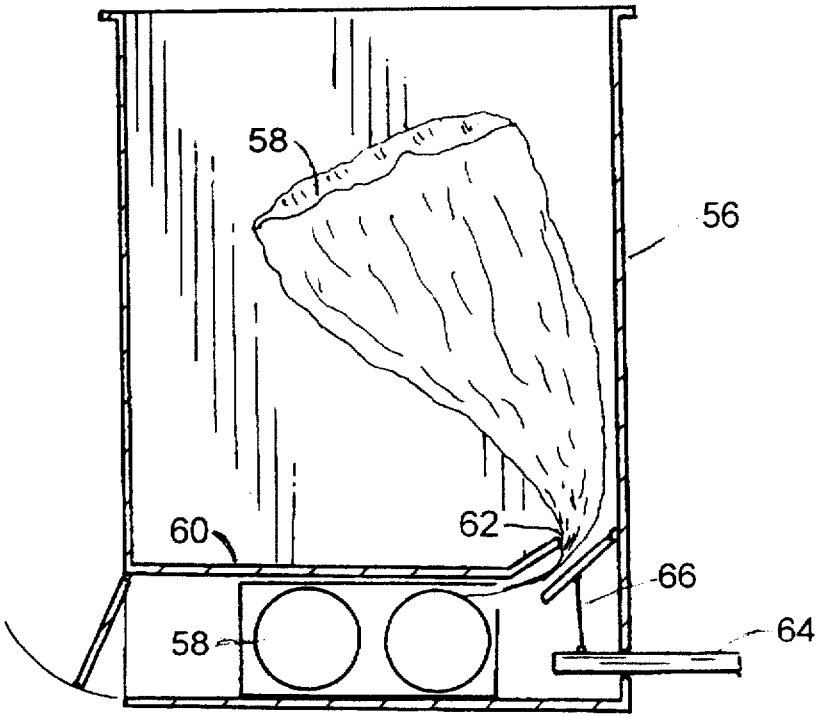
FIG. 7 is a sectional view of the trash container with trash bags fed into the floor of the container and showing a foot operated brake

FIG. 7 is a sectional elevational view of an alternate embodiment of a trash container 56 that may have a rectangular or circular cross section.. This embodiment is similar to that illustrated in FIGS. 1—6 except that, in FIG. 7, the trash bags 58 are stored in supply boxes under the floor 60 of the container 56 and drawn up into the container through a slot 62 in the floor. The embodiment of FIG. 7 has at one side, a pivotable hold down lever 64 that lifts a rod 66 that is coupled directly to a gate 68 that will cover the slot 62 to prevent the flow of trash bags into the container.

I claim:

1. A trash container with attached liner bag supply, said container comprising:

a container having a floor, a side wall and an open top, said container having a slot at its bottom for admitting liner bags;

means for supporting a box containing at least one roll of interconnected and separable liner bags, said box having an opening aligned with said slot: and braking means for temporarily locking an empty liner bag for removal of a preceding bag.

2. The trash container claimed in claim 1 wherein said means for supporting a box is on said side wall and said slot is in said side wall adjacent said floor.

3. The trash container claimed in claim 1 further including a narrow horizontal, inwardly-turned rim on top of said side wall, said braking means including an open ended slot in said rim for grasping an empty bag.

4. The trash container claimed in claim 2 wherein said means on said side wall includes horizontal tabs extending from said side wall for preventing vertical movement of said liner bag box and vertical resilient members for holding said bag box against said side wall, said resilient members being sprung outward to insert and remove a box.

5. The trash container claimed in claim 1 wherein said means for supporting a box is beneath said floor and said slot is in said floor.

6. The trash container claimed in claim 1 wherein said braking means includes a foot operated hold down lever adjacent said floor, said lever coupled to a gate that is moveable to cover said slot for temporarily braking said liner bags.

7. The trash container claimed in claim 1 wherein said liner bag box contains at least two rolls of liner bags, the first bag in each roll having a tear strip tab attached thereto for introduction of said roll into said container.

* * * * *